United States Patent [19]

Snyder, Jr. et al.

[11] Patent Number: 4,469,611

[45] Date of Patent: Sep. 4, 1984

[54] WATER-BASED HYDRAULIC FLUIDS

[75] Inventors: Kenneth L. Snyder, Jr.; William H. Keskey; Nitis Sarkar, all of Midland, Mich.

[73] Assignee: The Dow Chemical Company, Midland, Mich.

[21] Appl. No.: 438,546

[22] Filed: Nov. 1, 1982

[51] Int. Cl.[3] ..... C10M 3/04; C10M 3/12

[52] U.S. Cl. ..... 252/75; 252/49.3; 252/49.5; 252/52 A; 252/56 R; 252/73; 252/74; 252/76; 252/77; 252/78.5; 252/79; 526/287

[58] Field of Search ..... 252/49.3, 49.5, 52 A, 252/56 R, 73, 74, 75, 76, 77, 79, 78.5; 526/287

[56] References Cited

U.S. PATENT DOCUMENTS

| | | | |
|---|---|---|---|
| 3,177,146 | 4/1965 | Francis | 252/49.5 |
| 3,284,393 | 11/1966 | Vanderhoff et al. | 526/287 |
| 3,361,669 | 1/1968 | van Westen et al. | 252/18 |
| 3,652,497 | 3/1972 | Junas et al. | 525/190 |
| 3,794,608 | 2/1974 | Evani et al. | 524/517 |
| 4,008,202 | 2/1977 | Evani et al. | 526/287 |
| 4,029,873 | 6/1977 | Evani et al. | 525/449 |
| 4,029,874 | 6/1977 | Evani et al. | 526/304 |
| 4,038,265 | 7/1977 | Evani et al. | 524/521 |
| 4,061,684 | 12/1977 | Helfert et al. | 252/73 |
| 4,075,411 | 2/1978 | Dickstein | 524/43 |
| 4,080,304 | 3/1978 | Smith | 252/49.6 |
| 4,105,649 | 8/1978 | Evani et al. | 526/287 |
| 4,138,346 | 2/1979 | Nassry et al. | 252/45 |
| 4,151,099 | 4/1979 | Nassry et al. | 252/32.7 E |
| 4,257,902 | 3/1981 | Singer | 252/18 |
| 4,265,774 | 5/1981 | Langdon | 252/49.3 |
| 4,288,639 | 9/1981 | Camp | 568/625 |
| 4,303,537 | 12/1981 | Laepple et al. | 252/49.5 |
| 4,312,768 | 1/1982 | Nassry et al. | 252/32.7 E |
| 4,313,836 | 2/1982 | Nassry et al. | 252/32.7 E |
| 4,317,740 | 3/1982 | Eisenhard | 252/49.3 |

*Primary Examiner*—John E. Kittle
*Assistant Examiner*—Robert A. Wax

[57] ABSTRACT

Substantially oil-free aqueous industrial fluids possess superior lubricating and wear preventing characteristics and are useful as hydraulic fluids and metalworking compositions. Fluids of the invention comprise (1) an aqueous liquid and (2) a water-soluble synthetic addition copolymer of (a) an ethylenically unsaturated polyalkyleneoxy containing monomer, (b) an ethylenically unsaturated water-soluble monomer and, optionally, (c) an ethylenically unsaturated water-insoluble monomer.

The industrial fluids exhibit good Newtonian behavior and mechanical stability at higher shear.

28 Claims, No Drawings

WATER-BASED HYDRAULIC FLUIDS

BACKGROUND OF THE INVENTION

This invention relates to water-based hydraulic and metalworking fluids, in particular those fluids which are thickened with a water-soluble thickening agent.

Petroleum oils have traditionally been used as hydraulic fluids. Such oils exhibit good Newtonian viscosity behavior. A Newtonian fluid is a fluid that possesses a viscosity which is independent of the velocity gradient. Thus, the shear stress ($\tau$) is related to the shear rate ($\dot{\gamma}$) by the equation:

$$\tau=\eta\dot{\gamma}$$

wherein $\eta$ is the shear rate independent viscosity. Further, petroleum oils have a viscosity that is fairly constant throughout the lifetime of the fluid at prolonged high shear rates. This mechanical stability to shear degradation is a desired property of hydraulic fluids. The shear stable Newtonian viscosity of a typical hydraulic oil is generally in the range of 10 to 100 centistokes at 100° F. P Water-soluble lubricant products are gaining popularity due to shortages of petroleum base supplies, environmental concerns caused by problems in disposing of oil-based wastes, cost incentives and fire safety considerations. Typically, a water-based hydraulic fluid consists of several water-soluble or emulsifiable additives such as corrosion inhibitors (alkanolamines), lubricity aids (long chain carboxylic acid salts) and/or extreme pressure additives (zinc dialkyldithiosulfates, phosphate esters, borates, etc.). However, such an additive package has a viscosity that is essentially equal to that of water. It is desirable to thicken such a water-based lubricant with a water-soluble thickening agent to overcome the problems associated with the use of a low viscosity fluid.

Increased viscosity of the water-based hydraulic fluids is desirable for several reasons. In particular, thickened fluid can aid in the operation of system valves which have been designed to work specifically with oil-based fluids. Further, thickened fluids are less prone to experience leaking though small holes or cracks in the hydraulic system. Higher pump efficiencies are obtainable with thickened fluids, especially at high loads, and such fluids exhibit wear prevention characteristics in both hydrodynamic and elastohydrodynamic wear modes. It is desirable to provide a viscosity which is relatively constant throughout the lifetime of the fluid and relatively constant at varying shear rates. Shear rates in hydraulic vane pumps are estimated to be as high as one million reciprocal seconds.

For water-based hydraulic fluids, a polymer solution having a mechanically stable viscosity of about 10 to about 100 centistokes at 100° F. and a viscosity independent of shear rate at shear rates approaching up to about $10^6\,\text{sec}^{-1}$ is desirable. One way of describing the viscosity dependence on shear rate is through the use of the Power Law:

$$\ln\tau=N\ln\dot{\gamma}+\ln K.$$

Here, the shear stress ($\tau$) is found to vary in a nonlinear manner with shear rate ($\dot{\gamma}$). Thus, the viscosity changes with changes in shear rate. N is a measure of the extent of deviations from Newtonian behavior. A Power Law N value of 1.0 indicates a Newtonian fluid. Anything less than 1.0 is said to be shear-thinning. The K value relates to the fluid viscosity at 1 $\text{sec}^{-1}$. Further, for the sake of economic efficiency, it is desirable to keep the polymer concentration as low as possible. However, it is not always possible to provide a polymer system that exhibits a desired, mechanically stable hydrodynamic size and the desired Newtonian viscosity while maintaining a high polymer thickening efficiency.

Water-soluble polymers can be made in a variety of physical structures and molecular weights. High molecular weight linear polymers are highly efficient thickeners. However, such polymers exhibit non-Newtonian viscosity behavior and suffer from mechanical degradation at high shear rates. Reduction in molecular weight of the linear polymers increases the Newtonian character and mechanical stability of the thickener. Unfortunately, such low molecular weight polymers require high concentrations to thicken the fluid and thus are not economical.

It is desirable to produce compositions which, at low concentrations, exhibit a substantial thickening effect on the water in the aqueous hydraulic systems formed thereby, and provide the aqueous system with high viscosity and enhanced shear stability. It is also desirable that the viscosities in the aqueous hydraulic fluid systems employing the thickeners approach the viscosities of oil-based hydraulic systems, i.e., about 10 to about 100 centistokes at 100° F.

SUMMARY OF THE INVENTION

In one aspect, this invention is a substantially oil-free hydraulic fluid or metalworking composition which maintains a Newtonian shear stable viscosity comprising an aqueous liquid and a water-soluble synthetic addition copolymer consisting essentially of the reaction product of an ethylenically unsaturated polyalkyleneoxy containing monomer, a water-soluble ethylenically unsaturated monomer, and a water-insoluble ethylenically unsaturated monomer. Such a hydraulic fluid or metalworking composition comprises about 80 to about 99 weight percent aqueous liquid and about 1 to about 20 weight percent of a water-soluble synthetic addition copolymer consisting essentially of (1) about 5 to about 25 weight percent of an ethylenically unsaturated, polyalkyleneoxy containing monomer, (2) about 35 to about 94 weight percent of a water-soluble ethylenically unsaturated monomer and (3) about 1 to about 55 weight percent of an ethylenically unsaturated water-insoluble monomer. As used herein, the term "aqueous liquid" means water or an aqueous solution comprising additives commonly employed in aqueous hydraulic fluids, such as corrosion inhibitors, anti-wear agents, etc. The compositions of matter of this aspect of the present invention are thickened aqueous solutions which are pH responsive.

In another aspect, this invention is a substantially oil-free hydraulic fluid or metalworking composition which maintains a Newtonian shear stable viscosity comprising an aqueous liquid and a water-soluble synthetic addition copolymer consisting essentially of the reaction product of an ethylenically unsaturated polyalkyleneoxy containing monomer and a water-soluble ethylenically unsaturated monomer. Such a hydraulic fluid or metalworking composition comprises about 80 to about 99 weight percent aqueous liquid and about 1 to about 20 weight percent of a water-soluble synthetic addition copolymer consisting essentially of (1) about 5 to about 40 weight percent of a ethylenically unsaturated polyalkyleneoxy containing monomer and (2) about 60 to about 95 weight percent water-soluble monomer.

The hydraulic fluids and metalworking compositions of the present invention exhibit excellent lubricity and anti-wear characteristics, and are useful as coolants and lubricants of surfaces which are in frictional contact such as during operations of turning, cutting, peeling, grinding metals and the like. Such fluids and compositions are easily prepared, exhibit the desirable viscosities of oil-based hydraulic systems and maintain a relatively constant viscosity (i.e., provide a Newtonian shear stable viscosity) at high shear. As used herein, "high shear" means a shear rate of greater than about 1000 $sec^{-1}$. The hydraulic fluids and metalworking compositions are ecologically superior to those fluids and metalworking emulsions of the prior art containing petroleum oils, mineral oils or glycerol/water mixtures.

DETAILED DESCRIPTION OF THE INVENTION

The polyalkyleneoxy containing monomer is an ethylenically unsaturated monomer represented by the formula:

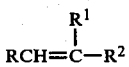

wherein R and $R^1$ are individually hydrogen, methyl, ethyl, propyl, butyl or other such lower alkyl; COOX wherein X is hydrogen or a lower alkyl; $—CH_2COOX$; halo or alkylhalo (halo is chloro or bromo), nitrile, $—C_6H_4Y$ wherein Y is hydrogen, lower alkyl or halo; $—NH_2$ or alkylamine. $R^2$ is represented by $—A(R^3O)_n—R^4$ wherein A is a suitable linking moiety such as —O—, —NH—, —S—,

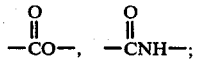

aryl or a lower alkyl substituted aryl; aralkyl such as

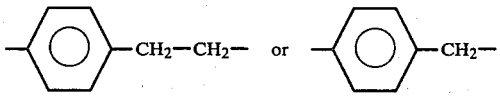

or lower alkyl such as $—CH_2—$ or $—CH_2CH_2—$. Alternatively, A may be absent. $R^3$ is lower alkyl, namely, ethyl, propyl, isopropyl, isobutyl, isopentyl and the like or combinations thereof; and n is an integer between 1 and 100, most preferably between 5 and 40. $R^4$ is hydrogen, alkyl or branched alkyl wherein the alkyl contains between 1 and about 9 carbon atoms; or

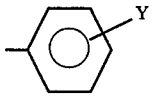

wherein Y is hydrogen or an alkyl containing between 1 to about 9 carbon atoms, or

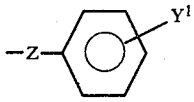

wherein Z and $Y^1$ are lower alkyl such that the number of carbon atoms comprising Z and $Y^1$ is in the range from 1 to about 9.

The especially preferred polyalkyleneoxy containing monomers are the acrylate and methacrylate esters such as:

o-alkylphenyl poly(ethyleneoxy)-2-alkyl propenoate

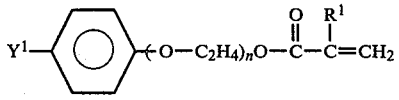

wherein $R^1$ is H or $CH_3$; $Y^1$ is hydrogen or an alkyl containing between 1 and about 9 carbon atoms, and n is about 4 to about 100;

o-alkyl poly(ethyleneoxy)-2-alkyl propenoate

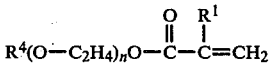

wherein $R^1$ is H or $CH_3$, $R^4$ is hydrogen or an alkyl containing between 1 an about 9 carbon atoms, and n is about 6 to about 50; and o-alkyl poly(alkyleneoxy)-2-alkyl propenoate

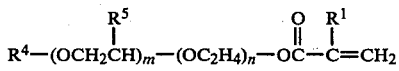

wherein $R^1$ is H or $CH_3$, each $R^5$ is methyl or ethyl, $R^4$ is hydrogen or an alkyl containing between 1 and about 9 carbon atoms, and n is about 6 to about 50 and m is about 1 to about 40.

These preferred polyalkyleneoxy containing monomers are the acrylic or methacrylic acid esters of certain nonionic surfactant alcohols. Such esters are known in the art. For example, Junas et al., U.S. Pat. No. 3,652,497 describe the use of alkylphenoxyethyleneoxyethyl acrylates in preparing several other polymeric surfactant thickeners. Dickstein, U.S. Pat. No. 4,075,411 describes several processes for preparing such vinyl surfactant esters including the acid catalyzed condensation of commercially available nonionic polyoxyalkylene surfactant alcohols such as alkylphenoxypoly(ethyleneoxy) alcohol and block-polymeric glycols with acrylic, methacrylic, crotonic, maleic, fumaric, itaconic or aconitic acid. Alternate esterification methods including alcoholysis and transesterification are also described.

Other especially preferred polyalkyleneoxy containing monomers are vinyl benzyl ethers such as:

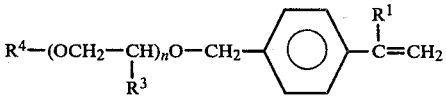

wherein $R^1$ is H or $CH_3$; $R^3$ is H, methyl or ethyl; $R^4$ is hydrogen or an alkyl containing between 1 and about 9 carbon atoms or

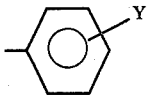

wherein Y is hydrogen or an alkyl containing between 1 and about 9 carbon atoms; and n is about 5 to about 100, most preferably 5 to 40. These monomers are known in the art. For example, Evani et al., U.S. Pat. Nos. 4,029,873 and 4,029,874 describe the use of such vinyl benzyl ethers in preparing surfactant thickeners. In addition, said patents disclose processes for preparing such vinyl benzyl ethers by reacting vinyl benzyl halides and nonionic surfactants prepared from the condensation of alkylene oxides.

Another class of water-soluble ethylenically unsaturated monomers that are copolymerizable with the aforementioned polyalkyleneoxy containing monomers are employed to extend the chain of the copolymer molecule and provide a water-soluble character to said copolymer. Said monomers may be cationic, anionic or nonionic, with anionic and nonionic being most preferred. Such water-soluble monomers include acrylic acid, methacrylic acid, ethacrylic acid and the like; sodium styrene sulfonate; sulfoethyl methacrylate; acrylamide, methacrylamide and the like; hydroxy-containing esters of $\alpha,\beta$-ethylenically unsaturated, aliphatic monocarboxylic acids such as $\beta$-hydroxypropyl methacrylate, 4-hydroxybutyl acrylate, 5-hydroxypentyl methacrylate, hydroxyethyl acrylate, hydroxypropyl acrylate, and the like; dicarboxylic acids or their anhydrides such as maleic anhydride, itaconic anhydride, citraconic anhydride, chloromaleic anhydride, fumaric acid, maleic acid, itaconic acid and the like or the half esters or half amides of said acids; ethylenimines and amino acrylates such as dimethylaminoethyl methacrylate and acrylamido-2-methylpropane sulfonic acid. Monomers such as vinyl acetate may be used since the polymers may be hydrolyzed to produce the alcohol group. It is most preferable that the monomer be potentially water-soluble upon an increase in pH of the aqueous solution (i.e., greater than about 7).

Copolymerizable monomers which may, optionally, be used include water-insoluble ethylenically unsaturated monomers which may be copolymerized with the aforementioned monomers preferably in an aqueous emulsion to form a water-insoluble polymer. These monomers are well known in the art and hence are illustrated below only by representative examples. The nonionic ethylenically unsaturated monomers are represented by, but not restricted to, hydrocarbon monomers such as the styrene compounds, such as styrene, $\alpha$-methylstyrene, ar-methylstyrene, ar-ethylstyrene, $\alpha$,ar-dimethylstyrene, ar,ar-dimethylstyrene and t-butylstyrene; the hydrocarbon monomers which are modified to possess nonionic substituents, such as hydroxystyrene, methoxystyrene and cyanostyrene; the unsaturated alcohol esters such as vinyl acetate and vinyl propionate; the unsaturated ketones, such as vinyl methyl ketone and methyl isopropenyl ketone; the unsaturated ethers, such as vinylethyl ether and vinyl methyl ether; and the nonionic derivatives of ethylenically unsaturated carboxylic acids such as acrylic esters which include methyl acrylate, ethyl acrylate, butyl acrylate, hexyl acrylate, 2-ethylhexyl acrylate and lauryl acrylate; methacrylic esters, such as methyl methacrylate, ethyl methacrylate; the maleic esters such as dimethyl maleate, diethyl maleate and dibutyl maleate; the fumaric esters, such as dimethyl fumarate, diethyl fumarate and dibutyl fumarate and the itaconic esters, such as dimethyl itaconate, diethyl itaconate and dibutyl itaconate; and the nitriles, such as acrylonitrile and methacrylonitrile. While not in the preferred class, nonionic monomers containing halogens which are not activated may be employed, such as monochlorostyrene, dichlorostyrene, vinyl fluoride, chloroprene, vinyl chloride, vinylidene chloride and the like.

Conventional chain transfer agents can also be employed in the practice of this invention and, indeed, in the polymerization stages it is preferable to do so. Examples of conventional chain transfer agents include bromoform, bromotrichloromethane, carbon tetrachloride and other alkyl halides; long chain mercaptans such as lauryl mercaptan; octyl mercaptan, tetradecyl mercaptan, hexadecyl mercaptan, dodecyl mercaptan and other such alkyl mercaptans; alkyl disulfides; 1,4,5,8-tetrahydronaphthalene; terpinolene; thioglycolic esters such as iso-octyl thioglycolate (IOTG), butyl thioglycolate and dodecyl thioglycolate; $\alpha$-methylstyrene dimer and alcohols such as isopropanol. Any conventional chain transfer agent can be used in regulating the molecular weight of the polymer formed herein and, typically, when such chain transfer agents are used, they are employed in amounts ranging from 0.10 to about 10.0 weight percent based on the weight of the monomers used in the polymerization steps herein.

Suitable emulsifying agents which can be employed in the copolymerization process include cationic, anionic or nonionic emulsifiers or detergents customarily used in emulsion polymerization. Preferably, at least one anionic emulsifier is included and one or more nonionic emulsifiers may also be present. Representative types of emulsifiers are the alkyl aryl sulfonates, alkali metal alkyl sulfates, the sulfonated alkyl esters, salts of high molecular weight fatty acids, amine soaps, alkali metal salts of rosin acids, ethylene oxide condensates of long chain fatty acids, alcohols or mercaptans. An example of a useful combination of emulsifiers is a tridecanolethyleneoxide condensate and an alkali metal salt of an aralkyl polyester sulfate. Specific examples of anionic emulsifiers known in the art include sodium dodecylbenzenesulfonate, sodium di(s-butyl)naphthalene sulfonate, sodium lauryl sulfate, disodium dodecyldiphenyl ether disulfonate, disodium n-octadecylsulfosuccinamate and sodium dioctylsulfosuccinate. A variety of nonionic surfactants and methods of their preparation are fully disclosed in "Nonionic Surfactants," Vol. 1, edited by M. J. Schick, published by Marcel Decker, Inc., New York, 1967. Suitable cationic surfactants include the classes of salts of aliphatic amines, especially the fatty amines, quaternary ammonium salts and hydrates, fatty chain derivatives of pyridinium compounds, ethylene oxide condensation products of fatty amines, sulfonium compounds, and phosphonium compounds. Specific examples include dodecylamine acetate, tetradecylamine, hydrochloride, octadecylamine sulfate, cetyl pyridinium chloride, oleyl imidazoline and cetyl dimethyl benzyl ammonium chloride. Other representative emulsifiers and detergents are disclosed in "McCutcheon's Detergents and Emulsifiers," North American Edition, published by McCutcheon Division, MC Publishing Co., Glen Rock, N.J., 1980.

While much less preferred, a suspension stabilizer may also be employed to ensure that the polymerization of the monomers takes place under suspension polymerization conditions. Examples of representative suspension stabilizing agents include polyvinyl alcohol, polymerization products of acrylic acid and methacrylic acid, polyvinyl pyrrolidone, polyvinyl ether, maleic anhydride copolymers, salts of styrenemaleic anhydride copolymers, gelatins, cellulose ethers and sorbitol. Suitable inorganic suspension stabilizers include sparingly soluble metal phosphates such as hydroxy apatite. These materials are well known in the art and are utilized in varying proportions depending upon the desired viscosity and efficiency of the thickening or viscosity increasing effect.

The free-radical producing initiators conveniently employed are peroxygen compounds, especially inorganic persulfate compounds such as ammonium persulfate, potassium persulfate and sodium persulfate; peroxides such as hydrogen peroxide; organic hydroperoxides, such as cumene hydroperoxide, t-butyl hydroperoxide, acetyl peroxide, lauroyl peroxide; peracetic acid and perbenzoic acid (sometimes activated by a water-soluble reducing agent such as a ferrous compound or sodium bisulfite); as well as other free-radical producing materials such as 2,2'-azobisisobutyronitrile.

Other ingredients well known in the art may be included for various specific purposes. Such additives include buffering agents, inorganic salts and pH adjusting agents. Preferably, chelating reagents are added to remove ferric and other free metal ions, as well as calcium and magnesium ions which interfere with polymerization processes.

The copolymerization may be carried out batchwise, stepwise or continuously with batch and/or continuous addition of monomers and/or reagents in a conventional manner. Most preferably, the polymerization reaction is carried out by concurrent addition of the monomer mix and an aqueous feed to an aqueous phase which has been preheated to between about 60° C. and about 90° C. and is under agitation. Addition rates may vary and may range from about 1 hour to about 10 hours, with 3 to 6 hours being most preferred. The system is allowed to react for about 1 to about 10 hours before cooling.

The copolymer thickeners are prepared from reacting the previously described monomers and reagents using conventional polymerization techniques. For example, copolymers may be prepared from reacting the aforementioned water-soluble monomers using aqueous solution polymerization techniques. Another well known and well documented method includes suspension polymerization using the aforementioned suspending agents. Additionally, the inverse emulsion polymerization process may be employed. Such water-in-oil emulsion polymerization procedures are taught in Vanderhoff et al., U.S. Pat. No. 3,284,393. The preferred method of preparation involves emulsion polymerizing the monomers at a pH of about 1.0 to about 5.0, preferably about 3.0 using free-radical producing initiators, usually in an amount from about 0.01 to about 3 parts based on 100 parts monomers.

The emulsion polymerization of the polyalkyleneoxy containing monomers, the water-soluble monomers and the water-insoluble monomers is optimally carried out under inert atmosphere (i.e., nitrogen) using a deionized or distilled water solvent treated with a small amount (i.e., less than about 0.01 part based on 100 parts monomers) of chelating agents. Most advantageously, a monomer mix containing 100 parts monomer, about 0 to about 10 parts of chain transfer agent, and 0 to about 10 parts surfactant (preferably nonionic) is added to the aqueous charge. An aqueous mix comprising 50 to about 200 parts distilled on deionized water treated with less than about 0.01 part chelating agent and mixed with 0 to about 5 parts anionic detergent, 0 to about 10 parts anionic, cationic or nonionic surfactant, 0 to about 5 parts of a pH adjustor such as hydrochloric acid or sodium hydroxide, and the previously mentioned amounts of initiators are added to the aqueous charge. After the reaction is completed and the mixture has cooled, 0 to about 10 parts of a neutralant such as sodium hydroxide, aqueous ammonia or monoisopropanolamine may be added along with stabilizers such as chelating reagents or formaldehyde. Coagulum is removed from the latex/aqueous mixture by filtration using a 200 mesh screen. Such latex particles are typically in the range of about 500 Å to about 3000 Å in size as determined by light scattering techniques.

In the practice of preparing the copolymer latex, it is desirable to copolymerize from about 5 to about 25, preferably about 10 to about 20, most preferably about 15, weight percent polyalkyleneoxy containing monomer, from about 1 to about 60, preferably from about 20 to about 55, most preferably about 30 to about 55, weight percent water-insoluble monomer, and from about 35 to about 94, preferably from about 35 to about 60, most preferably about 35 to about 55, weight percent water-soluble monomer.

The essential monomers can be copolymerized in such proportions and the resulting copolymer thickeners can be physically blended to give products with the desired balance of properties for specific applications. For example, if a more viscous product is desired, the amount of polyalkyleneoxy containing monomer in the copolymer may be increased and the pH of the aqueous environment decreased. The addition of a monomer which provides water insolubility characteristics to the copolymer (such as styrene) will increase the pH required to dissolve the copolymer, and thus provide a latex-type product.

In one aspect of this invention, the copolymer thickener prepared as above-described is pH responsive, wherein the term "pH responsive" means that the hydrophilicity of the copolymer varies with pH. The copolymer is substantially less hydrophilic in an aqueous liquid having a pH of less than about 5 than in a neutral or alkaline aqueous liquid. The ability of the copolymer to thicken the composition is a result of the aforementioned change in hydrophilicity wherein the copolymer is insoluble (i.e., hydrophobic) in an aqueous liquid at one pH, thereby having little or no affect on the viscosity or other properties of the aqueous liquid. At a second pH, the copolymer dissolves or swells sufficiently in the aqueous liquid to increase the viscosity of the liquid. Advantageously, the copolymer thickeners are essentially insoluble (i.e., preferably forming no more than about a 0.5 weight percent solution) in an aqueous liquid having a pH of less than about 5. The copolymer thickeners become highly viscous at a pH in the range of about 5 to about 7. Alternatively, in a neutral or alkaline aqueous liquid, the copolymer dissolves or swells extensively in said aqueous liquid. The copolymer dissolves or swells sufficiently in an aqueous liquid having a pH of at least about 7, preferably about 7 to about 12. The copolymer solution is most preferably employed at a pH in the range of from about 8.5 to about 10.

In the form of a stable, aqueous colloidal dispersion at an acid pH of about 3 to about 6, the copolymer is particularly useful. Such an aqueous dispersion may contain about 10 to about 50 weight percent of polymer solids, yet be of relatively low viscosity. Thus, it is readily metered and blended with aqueous product systems. However, the dispersion is pH responsive. When the pH of the polymer dispersion is adjusted by addition of a base such as ammonia, an amine or a non-volatile inorganic base such as sodium hydroxide, potassium carbonate or the like, the aqueous mixture becomes translucent or transparent as the polymer dissolves at least partially in the aqueous phase with a concurrent increase in viscosity. This neutralization can occur in situ when the liquid emulsion polymer is blended with an aqueous solution containing a suitable base. If desired for a given application, pH adjustment by partial or complete neutralization can be carried out before or after blending the liquid emulsion polymer with an aqueous product.

Alternatively, the copolymer thickeners are prepared using conventional aqueous solution polymerization techniques. Such a polymerization is optimally carried out under an inert atmosphere using deionized or distilled water treated with a chelating agent as previously described. Advantageously, such a polymerization process is performed at monomer concentration in the range of about 1 to about 20 weight percent in the aqueous environment in which the copolymer is prepared. Most preferably, a monomer concentration of about 5 to about 15 weight percent is preferred. A monomer mix containing 100 parts monomer is added to the aqueous charge which contains from about 0.01 to about 3 parts free radical producing initiators. After the reaction is completed and the system is cooled, the copolymer may be dried using conventional techniques or used in solution as so prepared.

In practice, it is normally desirable to copolymerize about 5 to about 40, preferably about 10 to about 20, most preferably about 15, weight percent based on the weight of the total monomers of the ethylenically unsaturated polyalkyleneoxy containing monomer and from about 60 to about 95, preferably about 80 to about 90, most preferably about 85, weight percent of the water-soluble monomer.

The copolymers which are prepared from the aforementioned polymerization techniques are useful as thickeners and can have viscosities as high as about 1500 centipoises as measured using a standard Brookfield viscometer as a 1 percent aqueous solution at a pH of about 9.5 and at about 25° C. However, such thickeners are extremely pseudoplastic and exhibit extremely poor Newtonian behavior. The preferred copolymers of this invention exhibit viscosities of less than about 600 centipoises, most preferably less than about 200 centipoises, as measured using a standard Brookfield viscometer as a 5 percent aqueous solution at a pH of about 9.5 and at about 25° C. Such copolymers exhibit extremely good Newtonian behavior.

The copolymer thickeners of the present invention are capable of thickening an aqueous liquid to provide the resulting fluid, a viscosity comparable to that of oil-based hydraulic fluids. By the term "thicken" is meant that the viscosity of the liquid is measurably increased upon the addition of the copolymer thickener thereto, when said viscosities are measured using conventional techniques such as with a Brookfield viscometer. The specific amount of copolymer present as a thickener in aqueous media will depend on a variety of factors including the end use application and the amount and composition of thickener employed.

The polyalkyleneoxy containing monomer introduces to the copolymer a hydrophilic side chain of from about 1 to about 100 alkyleneoxy units terminated with hydrogen or a hydrophobic moiety. An increased length of the polyalkyleneoxy moiety will increase the solubility of the resulting copolymeric thickener in water. However, an increased length of the polyalkyleneoxy moiety does not necessarily improve the shear stability of the resulting hydraulic fluid or metalworking composition because the increase in length of the polyalkyleneoxy moiety increases the hydrodynamic diameter of the copolymer at low shear and thus increases the coil density of the copolymer at high shear.

The hydrophobic moiety that terminates the hydrophilic polyalkyleneoxy side chain provides a surfactant character to the resulting copolymer. However, it is necessary to maintain the composition of said hydrophobic moiety within the aforementioned range in order to provide a copolymeric thickener which exhibits good Newtonian behavior. That is, if the hydrophobic moiety is larger than the range previously specified, it is possible that hydrophobic association between the terminating moieties of adjacent copolymer molecules at low shear imparts a non-Newtonian behavior upon the resulting hydraulic fluid or metalworking compositions.

The hydraulic fluids and metalworking compositions of the invention generally comprise from about 80 percent to about 99 percent aqueous formulation and from about 1 percent to about 20 percent copolymeric thickener. These aqueous formulations comprise water and additives such as other thickening agents, defoamers, corrosion inhibitors and metal deactivators or chelating agents. Preferably, said formulations comprise about 1 to about 15 weight percent copolymer thickener and about 85 to about 99 percent aqueous formulation. Most preferably, said fluids comprise about 90 percent to 99 percent aqueous formulations and about 1 percent to about 10 percent copolymer thickener. The fluids are easily formulated at room temperature using distilled or deionized water although tap water can also be used without adverse effects on the fluid properties.

Additives common to hydraulic or metalworking fluids may be added to the thickened compositions without hindering the desired properties of the hydraulic fluid or metalworking composition. For example, small amounts of corrosion inhibitors such as alkali metal nitrites, nitrates, phosphates, silicates and benzoates may be added as liquid-vapor phase corrosion inhibitors. Representative suitable organic inhibitors include hydrocarbyl amine and hydroxy-substituted hydrocarbyl amine neutralized acid compound, such as neutralized phosphates and hydrocarbyl phosphate esters, neutralized fatty acids (e.g., those having 8 to about 22 carbon atoms), neutralized aromatic carboxylic acids (e.g., 4-(t-butyl)benzoic acid), neutralized naphthenic acids and neutralized hydrocarbyl sulfonates. Mixed salt esters of alkylated succinimides are also useful. Particularly useful amines include the alkanolamines such as ethanolamine, diethanolamine, triethanolamine and the corresponding propanolamines.

Other amine-type corrosion inhibitors are morpholine, ethylenediamine, N,N-diethylethanolamine, alpha- and gamma-picoline, piperazine and isopropylaminoethanol. Other additives include colorants; dyes; deodorants such as citronella; bactericides and other antimicrobials; water softeners such as an ethylene diamino tetraacetate sodium salt or nitrilo triacetic acid; anti-freeze agents such as ethylene glycol and analogous polyoxyalkylene polyols; anti-foamants such as silicone-containing agents and shear stabilizing agents such as commercially available polyoxyalkylene polyols. Anti-wear agents, friction modifiers, anti-slip and lubricity agents may also be added. Such agents include metal or amine salts of an organo sulfur, phosphorus, boron or carboxylic acid which is the same as or of the type as used in oil-based fluids. Typical of such salts are carboxylic acids of 1 to 22 carbon atoms including both aromatic and aliphatic acids; sulfur acids such as alkyl and aromatic sulfonic acids and the like; phosphorus acids such as phosphoric acid, phosphorous acid, phosphinic acid, acid phosphate esters, and analogous sulfur homologs such as the thiophosphoric and dithiophosphoric acid and related acid esters; mercaptobenzothiozole; boron acids include boric acid, acid borates and the like. Useful functional additives also include lubricity aids such as metal dithiocarbamates including molybdenum and antimony dithiocarbamates; as well as dibutyltin sulfide, tributyltin oxide, phosphates and phosphites; borate amine salts, chlorinated waxes; trialkyltin oxide, molybdenum phosphates and chlorinated waxes.

It should also be noted that many of the ingredients described above for use in making the substantially oil-free hydraulic fluids and metalworking compositions of this invention are industrial products which impart more than one property to the composition. Thus, a single ingredient can provide several functions thereby eliminating or reducing the need for some other additional ingredient. Thus, for example, a dispersing agent may also serve in part as an inhibitor of corrosion. Similarly, it may also serve as a neutralizing agent to adjust pH or as a buffer to maintain pH. Similarly, a lubricity agent such as tributyltin oxide can also function as a bactericide. In addition, lauric acid, when employed in small amounts as a lubricity aid, may also act as as a viscosity enhancing agent.

The hydraulic fluid and metalworking compositions of this invention, when formulated as taught above, are transparent or slightly turbid liquids having a viscosity of up to about 1500 centipoises at 100° F., which are stable over long periods of storage at ambient temperature. Most preferably, hydraulic fluids and metalworking compositions of this invention are formulated such that the viscosity is between about 10 and about 100 centipoises at 100° F. In addition, the hydraulic fluids and metalworking additives of the invention are substantially oil-free and will not support combustion in contrast to those flame-resistant fluids of the prior art based upon a glycol and water or petroleum oils. The hydraulic fluids and metalworking additives of the invention are ecologically clean and nonpolluting compositions when compared to existing petroleum-based hydraulic fluids. Since the hydraulic fluids and metalworking additives of the invention are largely based upon synthetic materials which are not derived from petroleum, the production of such fluids is relatively independent of shortages of petroleum oil and not materially influenced by the economic impact of such shortages.

The hydraulic fluids of the invention can be used in various applications requiring hydraulic pressures in the range of up to about 2,000 pounds per square inch since they have all the essential properties such as lubricity, viscosity and corrosion protection. The hydraulic fluids of the invention are suitable for use in various types of hydraulic systems and are especially useful in systems in which vane-type pumps or the axial-piston pumps are used. Such pumps are used in hydraulic systems where pressure is required for molding, clamping, pressing metals, actuating devices such as doors, elevators and other machinery or for closing dies in die-casting machines and in injection molding equipment and other applications.

The hydraulic fluids and metalworking compositions of the present invention can be used in methods for shaping solid material with a work tool by lubricating the tool and/or the material. These shaping processes comprise cutting, grinding, drilling, punching, stamping, turning, lapping, polishing, rolling, drawing and combinations of said processes. Often the solid material is a metal work piece or it may be earth, rock, sand, concrete or a mixture of these. When the work piece is metal, it can comprise at least one ferrous or at least one nonferrous metal or a combination of both. When the material is earth, rock, sand, concrete, cement or a mixture of these, the tool is often a drill of rotary or percussion-type and the earth, rock, sand, concrete, cement or a mixture of same, overlies a naturally occuring deposit, such as a deposit of fossil fuel, an ore body, or an economically valuable mineral such as gem stones and the like.

The following examples are given to further illustrate the invention and should not be considered as limiting the scope thereof. All percentages are in weight percent unless otherwise noted. All parts are based on 100 parts weight of total monomer.

EXAMPLE 1

To a stainless steel-jacketed reactor equipped with pulse feeder pumps for delivering monomer and aqueous feed streams and an agitation means is added 375 parts deionized water, 0.0075 part chelating agent such as VERSENEX ®80 which is sold commercially by The Dow Chemical Company, and 2 parts of an anionic detergent such as the free acid of a complex of an organic phosphate ester which is sold commercially under the trade name Gafac* RE 610 by G.A.F. Corporation. The charge is purged with nitrogen and preheated to 80° C.

®Trademark of The Dow Chemical Company.
* Trademark of G.A.F. Corporation.

A monomer mix comprising 44.5 parts ethyl acrylate, 40.5 parts methacrylic acid, 15 parts nonyloxypoly(ethyleneoxy)$_{39}$ ethyl methacrylate, 6 parts nonionic surfactant such as nonylphenoxypoly(ethyleneoxy)ethanol sold commercially under the trade name Igepal* CO5350 by G.A.F. Corporation and 1.25 parts iso-octyl thioglycolate (IOTG).

An aqueous mix comprising 70 parts deionized water, 0.0025 part chelating agent, 1 part anionic detergent, 2 parts anionic surfactant such as dodecyldiphenyl ether disulfonate sold commercially as DOWFAX ®2A1by The Dow Chemical Company, 0.4 part sodium hydroxide and 0.5 part sodium persulfate is prepared.

Each of the monomer mixture and aqueous mixture is continuously added to aqueous charge while under nitrogen purge for a period of 4 hours. The system is stirred at about 230 rpm and maintained at 80° C. After the two mixtures have been added, the system is maintained at 80° C. and agitated for an additional 1.5 hours in order to complete the reaction. The system is then cooled to room temperature and 4 parts of a neutralant such as Daxad TM 30 sold commercially by W. R. Grace is added along with 0.4 part of a formaldehyde stabilizer. The process yields a copolymer with a viscosity of 50 centipoises as measured using a Brookfield viscometer, 5.0 percent aqueous solution at a pH of 9.5 and 25° C. The percent solids is 20 percent. The copolymer prepared by this recipe is designated "Sample No. 1."

TM Trademark of W. R. Grace

In a similar manner, a copolymer (Sample No. 2), which is similar in all respects to Sample No. 1, is prepared except using a nonylphenoxy(ethyleneoxy)$_9$ ethyl methacrylate.

In a similar manner, a copolymer (Sample No. 3), which is similar in all respects to Sample No. 1, is prepared except using 1 part IOTG.

In a similar manner, a copolymer (Sample No. 4), which is similar in all respects to Sample No. 1, is prepared except using 0.3 part IOTG, 47 parts ethylacrylate, 43 parts methacrylic acid and 10 parts nonylphenoxy(ethyleneoxy)$_{39}$ ethyl methacrylate.

In a similar manner, a copolymer (Sample No. 5), which is similar in all respects to Sample No. 4, is prepared except that no IOTG is employed.

EXAMPLE 2

Samples 1, 3, 4 and 5 of Example 1 are dissolved in distilled water and are tested at low and high shear. The Power Law data is shown in Table I.

TABLE I

| Sample | IOTC[2] (Parts) | Conc.[3] (wt %) | Viscosity[1], cSt Low Shear[4] | Viscosity[1], cSt High Shear[5] | Power Law N |
|---|---|---|---|---|---|
| 5 | 0 | 0.5 | 41.0 | 14.9 | .70 |
| 4 | 0.3 | 1.6 | 38.6 | 26.4 | .89 |
| 3 | 1.0 | 3.0 | 35.3 | 34.0 | .99 |
| 1 | 1.25 | 4.0 | 40.9 | 40.0 | ~1.00 |

[1]Measured at 40° C. 3 percent aqueous solution at a pH of about 10 using a Haake Rotoviscometer.
[2]IOTG parts are parts per 100 parts monomer.
[3]Concentrations of aqueous solutions are in weight percent of copolymer in the appropriate sample.
[4]Low shear is 116 $sec^{-1}$ using a NV system.
[5]High shear is 3140 $sec^{-1}$ using a NV system.

The data indicates that as the amount of chain transfer agent used in the copolymer synthesis process is decreased, the concentration of copolymer required in solution to provide a high viscosity at low shear decreases. However, as reflected by the Power Law data, a highly efficient copolymeric thickener does not provide the fluid with the best Newtonian properties. The data indicates that samples prepared with less than 1 part chain transfer agent provide good thickening efficiency but exhibit poor Newtonian behavior. Conversely, samples prepared with 1 part chain transfer agent or more exhibit excellent Newtonian behavior but require greater concentrations of copolymeric thickener to provide the desired viscosity. If higher amounts of chain transfer agent are employed in the preparation of the copolymeric thickener, samples of comparable viscosity must be prepared at concentrations of higher than about 4 weight percent. However, the Newtonian behavior of the samples is not increased to any significant extent over the specific shear rate range thus indicating that, for this example, a copolymeric thickener concentration of about 3 to about 4 weight percent in water offers a good balance between high polymeric thickening efficiency and good Newtonian behavior.

EXAMPLE 3

A 5-percent formulation of Sample 1 of Example 1 in water has its pH adjusted with a sodium hydroxide solution. The viscosity of the solution is measured with a Brookfield viscometer at 25° C. over a range of pH. Data is shown in Table II.

TABLE II

| pH | Viscosity cps |
|---|---|
| 6.0 | 18.9 |
| 6.2 | 30.5 |
| 6.3 | 45.2 |
| 6.4 | 55 |
| 7.0 | 69 |
| 8.6 | 69.6 |
| 11.0 | 69.7 |

The data in Table II indicates the thickener of this example has a low viscosity at a low pH and can thus be easily handled at high concentrations. However, upon neutralization to pH 7 with a base, the viscosity increases dramatically. Over the pH range of 7 to 11 (typical of use), the viscosity is relatively high and remains essentially constant.

EXAMPLE 4

A 5-percent thickener mixture is prepared using portions of Sample 1 of Example 1, 2 percent lauric acid and 500 ppm anti-foaming agent such as that sold commercially under the trade name Dow Corning DB110-A by the Dow Corning Corporation. The pH of the mixture is adjusted to about 10.0 with sodium hydroxide. The mixture is designated Sample 6.

A 5-percent thickener mixture as described above is prepared, except that about 1.35 percent lauric acid is employed in the mixture. This mixture is designated Sample 7.

A 4-percent thickener mixture is prepared using portions of Sample 2 of Example 1, 1 percent lauric acid and 500 ppm anti-foaming agent such as that sold commercially under the trade name Dow Corning DB110-A. The pH of this mixture is adjusted to about 9.5 using sodium hydroxide. The mixture is designated Sample 8.

A 4-percent thickener mixture is prepared using portions of Sample 2 of Example 1, about 1 percent lauric acid and 3.5 percent diethylethanolamine as a corrosion inhibitor. The pH of the mixture is about 9.5. The mixture is designated Sample 9. The wear using Samples 6–9 as lubricants is measured using a Falex simulated vane pump test on a Falex Model 6 Friction and Wear Tester. Results are shown in Table III below:

TABLE III

| Sample[1] | Wear, (mg) |
|---|---|
| 6 | 3 |
| 7 | 15 |
| 8 | 4 |
| 9 | 6 |

[1]Samples were tested at 50° C. under 400 lbs load, at 1000 rpm for 100 minutes.

The data of Table III indicates very low wear when said samples are used as hydraulic fluids in such a test. Alternatively, three commercially available water-based hydraulic fluids, when tested under similar conditions, yield wear values of 19 mg to 25 mg.

EXAMPLE 5

The viscosity of Sample 9, described in Example 4, is measured at various temperatures. The results are presented in Table IV, below:

TABLE IV

| Temp (° C.) | 25 | 30 | 35 | 40 | 45 | 50 | 55 | 65 |
|---|---|---|---|---|---|---|---|---|
| Viscosity[1] | | | | | | | | |
| Sample 9 | 133 | 92 | 73 | 53 | 44 | 32 | 26 | 17 |
| Sample A[2] | 130 | 80 | 57 | 38 | 25 | 15 | 9 | 3 |

[1]Viscosity measured in centistokes using a Cannon-Fenske Tube Viscometer.
[2]Sample A is a commercially available water-based hydraulic fluid.

The above data indicates that viscosity decreases with an increase in temperature, as may be expected for such a system. However, it is surprisingly found that at a relatively high temperature (i.e., 65° C.), there is still good viscosity exhibited by Sample 9. Alternatively, the commercially available hydraulic fluid (Sample A) exhibits a lower viscosity over a comparable temperature range.

EXAMPLE 6

The degradation stability of selected samples is measured. This is a measure of the viscosity after the fluid has been subjected to shear in a Waring Blendor for about 30 minutes. The results are presented in Table V below:

TABLE V

| Sample[1] | Percent Visc. Retained |
|---|---|
| 3 | 93 |
| 5 | 94 |
| 9 | 100 |

[1]A shear of about $10^6$ $sec^{-1}$ is supplied for about 30 minutes prior to measurements.

The above data indicates that the fluids of this invention retain good viscosity after having been subjected to high shear. This good degradation stability of the samples of this invention indicates a highly Newtonian fluid which maintains its good properties over periods of repeated use. Alternatively, a commercially available hydraulic fluid tested under similar conditions maintains only 84 percent of its initial viscosity.

EXAMPLE 7

A 5-percent formulation of Sample 1 of Example 1 in water is mixed with lauric acid, a typical lubricity additive. The viscosity of the solution is measured with a Brookfield viscometer at 25° C. at a pH of about 10.0. The viscosities of the solutions show an enhancement obtained through the addition of lauric acid. Data is shown in Table VI.

TABLE VI

| % Lauric Acid | Viscosity of Formulation |
|---|---|
| 0 | 14.7 |
| 0.5 | 41.0 |
| 1.0 | 45.0 |
| 1.5 | 37.0 |
| 2.0 | 20.0 |

The data in Table VI indicates that small amounts (i.e., at a concentration of about 0.5 to about 2.0 percent) of lauric acid increase the viscosity of the solution. This indicates that lauric acid acts not only as a lubricity additive but also synergistically enhances the viscosity of the thickened formulation.

What is claimed is:

1. A substantially oil-free hydraulic fluid or metalworking composition which maintains an essentially Newtonian and shear stable viscosity comprising an aqueous liquid and a thickening amount of a water-soluble synthetic addition copolymer consisting essentially of the reaction product of an ethylenically unsaturated polyalkyleneoxy containing monomer, a water-soluble ethylenically unsaturated monomer and a water-insoluble ethylenically unsaturated monomer such that the visocisty of said composition approaches that of an oil-based hydraulic fluid or metalworking composition.

2. A substantially oil-free hydraulic fluid or metalworking composition which maintains an essentially Newtonian and shear stable visocisty comprising an aqueous liquid and a thickening amount of a water-soluble synthetic addition copolymer consisting essentially of the reaction product of an ethylenically unsaturated polyalkyleneoxy containing monomer and a water-soluble ethylenically unsaturated monomer such that the viscosity of said composition approaches that of an oil-based hydrualic fluid or metalworking composition.

3. A substantially oil-free hydraulic fluid or metalworking composition of claim 1 comprising about 80 to 90 weight percent of an aqueous liquid and about 1 to about 20 weight percent of a water-soluble synthetic addition copolymer consisting essentially of (1) about 5 to about 25 weight percent of an ethylenically unsaturated, polyalkyleneoxy containing monomer, (2) about 35 to about 94 weight percent of a water-soluble ethylenically unsaturated monomer and (3) about 1 to about 55 weight percent of an ethylenically unsaturated water-insoluble monomer.

4. A substantially oil-free hydraulic fluid or metalworking composition of claim 2 comprising about 80 to about 99 weight percent aqueous liquid and about 1 to about 20 weight percent of a water-soluble synthetic addition copolymer consisting of (1) about 5 to about 40 weight percent of an ethylenically unsaturated polyalkyleneoxy containing monomer and (2) about 60 to about 95 weight percent of an ethylenically unsaturated water-soluble monomer.

5. A hydraulic fluid or metalworking composition of claim 3 comprising about 90 to about 99 weight percent aqueous liquid.

6. A hydraulic fluid or metalworking composition of claim 4 comprising about 90 to about 99 weight percent aqueous liquid.

7. A hydraulic fluid or metalworking composition of claim 3 comprising a water-soluble synthetic addition copolymer consisting essentially of (1) about 10 to about 20 weight percent ethylenically unsaturated, polyalkyleneoxy containing (2) about 35 to about 60 weight percent water-soluble ethylenically unsaturated monomer and (3) about 20 to about 55 weight percent ethylenically unsaturated water-insoluble monomer.

8. A hydraulic fluid or metalworking composition of claim 4 comprising a water-soluble addition copolymer consisting essentially of (1) about 10 to about 20 weight percent ethylenically unsaturated, polyalkyleneoxy containing surfactant monomer and (2) about 80 to about 90 weight percent water-soluble ethylenically unsaturated monomer.

9. A hydraulic fluid or metalworking composition of claim 1 having a pH of at least 7.

10. A hydraulic fluid or metalworking composition of claim 1 wherein said ethylenically unsaturated polyalkyleneoxy containing monomer is selected from a member of the group consisting of an alkylphenoxypoly(ethyleneoxy)methacrylate, an alkoxypoly(ethyleneoxy)methacrylate, a poly(ethyleneoxy)alkylmethacrylate, an alkoxy poly(ethyleneoxy) vinyl benzyl ether and an alkylphenoxypoly(ethyleneoxy) vinyl benzyl ether.

11. A hydraulic fluid or metalworking composition of claim 2 wherein said ethylenically unsaturated polyalkyleneoxy containing monomer is selected from a member of the group consisting of an alkylphenoxypoly(ethyleneoxy)methacrylate, an alkoxypoly(ethyleneoxy)methacrylate, a poly(ethyleneoxy)alkylmethacrylate, an alkoxy poly(ethyleneoxy) vinyl benzyl ether and an alkylphenoxypoly(ethyleneoxy) vinyl benzyl ether.

12. A hydraulic fluid or metalworking composition of claim 1 wherein said water-soluble monomer is selected from a member of the group consisting of acrylic acid, methacrylic acid, acrylamide, maleic anhydride, methacrylamide and dimethyl aminoethyl methacrylate.

13. A hydraulic fluid or metalworking composition of claim 2 wherein said water-soluble monomer is selected from a member of the group consisting of acrylic acid, methacrylic acid, acrylamide, maleic anhydride, methacrylamide and dimethyl aminoethyl methacrylate.

14. A hydraulic fluid or metalworking composition of claim 1 wherein said water-insoluble ethylenically unsaturated monomer is selected from the group consisting of styrene, α-methyl styrene, methylacrylate, butylacrylate, ethylacrylate, methylmethacrylate, ethylmethacrylate, acrylonitrile, methacrylonitrile, vinyl chloride and vinylidene chloride.

15. A hydraulic fluid or metalworking composition of claim 1 wherein said copolymer comprises (1) about 15 weight percent nonyloxypoly(ethyleneoxy)$_{39}$ ethyl methacrylate, (2) about 44.5 weight percent ethylacrylate and (3) about 40.5 weight percent methacrylic acid.

16. A hydraulic fluid or metalworking composition of claim 1 wherein said copolymer comprises (1) about 15 weight percent nonyloxypoly(ethyleneoxy)$_{9}$ ethyl methacrylate, (2) about 44.5 weight percent ethylacrylate and (3) about 40.5 weight percent methacrylic acid.

17. A hydraulic fluid or metalworking composition of claim 1 wherein said aqueous liquid contains an antifoaming agent.

18. A hydraulic fluid or metalworking composition of claim 2 wherein said aqueous liquid contains an antifoaming agent.

19. A hydraulic fluid or metalworking composition of claim 1 wherein said aqueous liquid contains a lubricity aid.

20. A hydraulic fluid or metalworking composition of claim 2 wherein said aqueous liquid contains a lubricity acid.

21. A hydraulic fluid or metalworking composition of claim 1 wherein said aqueous liquid contains a corrosion inhibitor.

22. A hydraulic fluid or metalworking composition of claim 2 wherein said aqeous liquid contains a corrosion inhibitor.

23. A composition of claim 1 wherein said polyalkyleneoxy containing monomer is represented by the formulae:

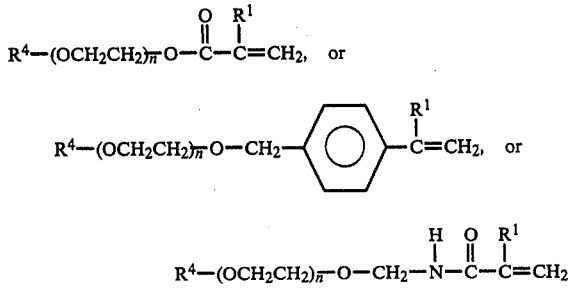

wherein $R^1$ is hydrogen or methyl, n is from 0 to 100, and $R^4$ is hydrogen or alkyl containing from 1 to about 9 carbon atoms.

24. A composition of claim 23 comprising about 90 to about 99 weight percent aqueous liquid.

25. A composition of claim 2 wherein said polyalkyleneoxy containing monomer is represented by the formulae:

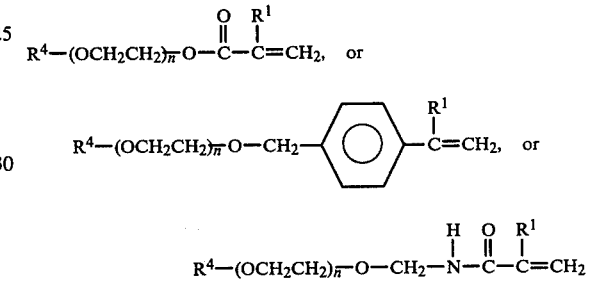

wherein $R^1$ is hydrogen or methyl, n is from 0 to 100, and $R^4$ is hydrogen or alkyl containing from 1 to about 9 carbon atoms.

26. A composition of claim 25 comprising about 90 to about 99 weight percent aqueous liquid.

27. A composition of claim 3 wherein said polyalkyleneoxy containing monomer is represented by the formulae:

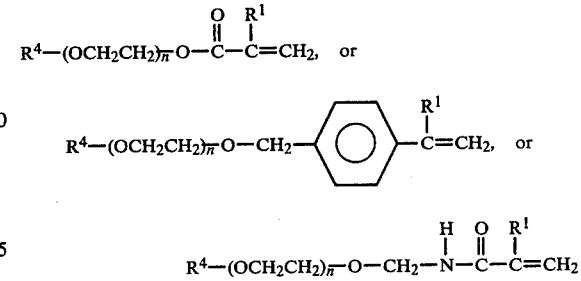

wherein $R^1$ is hydrogen or methyl, n is from 0 to 100, and $R^4$ is hydrogen or alkyl containing from 1 to about 9 carbon atoms.

28. A composition of claim 4 wherein said polyalkyleneoxy containing monomer is represented by the formulae:

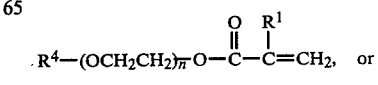

-continued
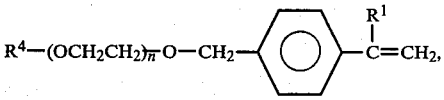
or
-continued
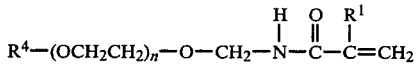
wherein $R^1$ is hydrogen or methyl, n is from 0 to 100, and $R^4$ is hydrogen or alkyl containing from 1 to about 9 carbon atoms.
* * * * *